US006672012B2

(12) United States Patent
Bahroos et al.

(10) Patent No.: US 6,672,012 B2
(45) Date of Patent: Jan. 6, 2004

(54) GUTTER COVER DEVICE

(75) Inventors: Gobind Bahroos, Riverview, MI (US); David Eisenbraun, Cordova, TN (US); Daniel Ford, Ypsilanti, MI (US); Stephen Gibbons, Livonia, MI (US); Dimitris Katsamberis, Novi, MI (US); Dennis Maiello, Collierville, TN (US)

(73) Assignee: American Metal Products Company, Olive Branch, MI (US)

( * ) Notice: Subject to any disclaimer, the term of this patent is extended or adjusted under 35 U.S.C. 154(b) by 134 days.

(21) Appl. No.: 10/043,813

(22) Filed: Jan. 10, 2002

(65) Prior Publication Data

US 2002/0152692 A1 Oct. 24, 2002

Related U.S. Application Data

(60) Provisional application No. 60/267,795, filed on Feb. 8, 2001.

(51) Int. Cl.[7] ..... E04D 13/04

(52) U.S. Cl. ..... 52/11; 52/11; 52/13; 52/14; 210/162; 210/532.1; 210/538; 210/801; 405/118; 405/119; 428/40; 428/141; 428/457; 428/489; 428/491; 428/906

(58) Field of Search ..... 52/11, 13, 14, 52/12; 210/162, 801, 538, 532.1; 405/119, 118; 428/40, 141, 457, 489, 491, 906

(56) References Cited

U.S. PATENT DOCUMENTS

| | | | | | |
|---|---|---|---|---|---|
| 4,146,937 | A | * | 4/1979 | Baker | 210/169 |
| 4,404,775 | A | * | 9/1983 | Demartini | 210/162 |
| 4,435,925 | A | | 3/1984 | Jefferys | |
| 5,072,551 | A | * | 12/1991 | Manoogian, Jr. | 210/232 |
| 5,096,759 | A | * | 3/1992 | Simpson et al. | 428/141 |
| 5,181,350 | A | | 1/1993 | Meckstroth | |
| 5,375,379 | A | | 12/1994 | Meckstroth | |
| 5,459,965 | A | | 10/1995 | Meckstroth | |
| 5,640,809 | A | | 6/1997 | Iannelli | |
| 5,711,127 | A | * | 1/1998 | Sabourin | 52/519 |
| 5,888,142 | A | * | 3/1999 | Perrier | 273/DIG. 24 |
| 6,016,631 | A | * | 1/2000 | Lowrie, III | 52/12 |
| 6,098,344 | A | * | 8/2000 | Albracht | 52/12 |
| 6,098,345 | A | * | 8/2000 | Demartini et al. | 210/474 |
| 6,245,183 | B1 | * | 6/2001 | Iorio et al. | 156/244.14 |
| 6,269,592 | B1 | * | 8/2001 | Rutter | 248/48.1 |
| 6,384,158 | B1 | * | 5/2002 | Bamberger et al. | 526/114 |

OTHER PUBLICATIONS

Sax, N. Irving and Lewis, Richard, Hawley's Condensed Chemical Dictionary, Sep. 1987, Van Nostrand Reinhold Company, Ney York, 11$^{th}$ edition, pp. 934, 946–947, 1039–1040.* www.valsparcomposites.com; www.valsparrefinish.com.*

Publication—Leafree, The Filter Makes The Difference—Dated 1999.

(List continued on next page.)

*Primary Examiner*—Carl D. Friedman
*Assistant Examiner*—Christy M. Green
(74) *Attorney, Agent, or Firm*—Calfee, Halter & Griswold LLP

(57) ABSTRACT

A gutter cover for directing the flow of rainwater from a building roof into a gutter mounted to the peripheral edge thereof while preventing debris such as leaves and twigs from entering and clogging the gutter. The cover is secured to the roof of the building such that rainwater flowing down the shingles will flow across the cover at the bottom roof line. A lower end of the cover has an arcuate nose disposed substantially above the outer edge of the gutter. The surface of the gutter is treated with one or more combinations of coatings and/or substrate textures to slow the flow of water while improving flow to the cover surface. Rainwater will flow around the arcuate nose into the gutter while debris carried by the rainwater is expelled outwardly over the edge of the gutter.

9 Claims, 2 Drawing Sheets

OTHER PUBLICATIONS

Publication—Memphis Gutter Works—Dated Nov. 1997.
Publication—Waterloov, Your All Season Gutter Protection System—Dated 1996.
Publication—The Waterfall Gutter Guard System—Dated 1997.
Publication—Tilt 'n Clean Rain Gutter Systems—Dated 1999.
Publication—Rain Master—Dated 1997.
Publication—Leafproof—Dated 1997.
Publication—K–Guard—Dated 1999.
Publication—Gutter Topper—The Simple Solution to Gutter Pollution—Dated Oct. 1999.
Publication—Hallett Gutter Cover—Dated 1997.

* cited by examiner

GUTTER COVER DEVICE

RELATED APPLICATIONS

This application claims priority from U.S. Provisional Application No. 60/267,795 filed on Feb. 8, 2001.

BACKGROUND OF THE INVENTION

I. Field of the Invention

This invention relates to a cover to prevent debris from entering a rain gutter while directing fluid flow from a roof into the gutter for diversion to the ground and, in particular, to a gutter cover having a unique surface formulation and texture to assure diversion and spreading of the fluid flow along the cover surface into the gutter while resisting staining and the build-up of dirt.

II. Description of the Prior Art

A variety of devices have been employed to prevent debris such as leaves and twigs from entering a gutter system. Such debris can clog the gutter preventing water from being properly diverted and over time can cause deterioration of the gutter. The prior known gutter covers have included everything from simple screens placed over the top of the gutter to complex devices designed to slow the water flow to ensure entry into the gutter while expelling debris over the outside edge of the gutter.

One of the best operating gutter covers is the Gutter Helmet® cover as substantially disclosed in U.S. Pat. No. 4,404,775. This cover is secured to the roof proximate the gutter such that rainwater flows from the roof onto the gutter cover. The cover includes a radiused outer nose which is positioned over the outer edge of the gutter to ensure that debris is expelled beyond the outer edge. The radiused nose is designed to direct water into the gutter. The surface tension of the water flowing across the cover causes the flow to follow the radiused nose into the gutter. However, it has been determined that increased flow rates, such as those that would be found on roofs with high pitches, can sometimes result in the water flowing over the edge of the gutter. The Gutter Helmet® cover attempts to reduce the flow rates by incorporating a series of raised ribs. Incorporation of the ribs is an additional manufacturing step while increasing the visibility of the cover.

SUMMARY OF THE PRESENT INVENTION

The gutter cover device of the present invention overcomes the disadvantages of the prior known covers by incorporating a combination of surface textures and coatings to improve the flow of the water to the cover surface thereby ensuring delivery of the water into the gutter.

The gutter cover of the present invention is supplied in elongated panels for attachment to a building roof proximate the rain gutter. The preferred embodiment of the gutter cover includes a planar surface having an inner edge designed to be affixed to the building roof and an outer edge which is formed into an arcuate nose. A series of ribs may be employed on the surface to divert and spread the water flow. The bend forming the arcuate nose results in the cover material extending back towards the interior of the gutter such that water adhering to the cover will be directed into the gutter trough. A plurality of clips may be used to fasten the outer edge of the cover to the gutter.

In order to improve the flow of the water to the panel so that it travels around the arcuate nose and into the gutter, a combination of coatings, substrates and textures are applied. The coatings and substrates aid in the release of dirt from the panel, increase the resistance to fading and staining while also improving the flow of the water across the panel. By incorporating a textured surface, the flow of the water is slowed and spread across an increased surface area of the panel ensuring that it will flow into the gutter while expelling debris over the gutter.

Possible substrate textures include a stucco dimpled, pimpled, or diamond pattern embossed in the material. Possible coatings for the panel include a polyester based coating, a silicone polyester based coating and a polyvinylidine fluoride based coating. The coatings may be used in conjunction with the substrate textures to improve water flow. Certainly, the coating material could be used to create the texture. The surface coating formulation and texture are used to improve the fluid flow across the cover. A formulation is chosen which is resistant to staining and the build-up of dirt or organic material along the arcuate nose of the cover.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
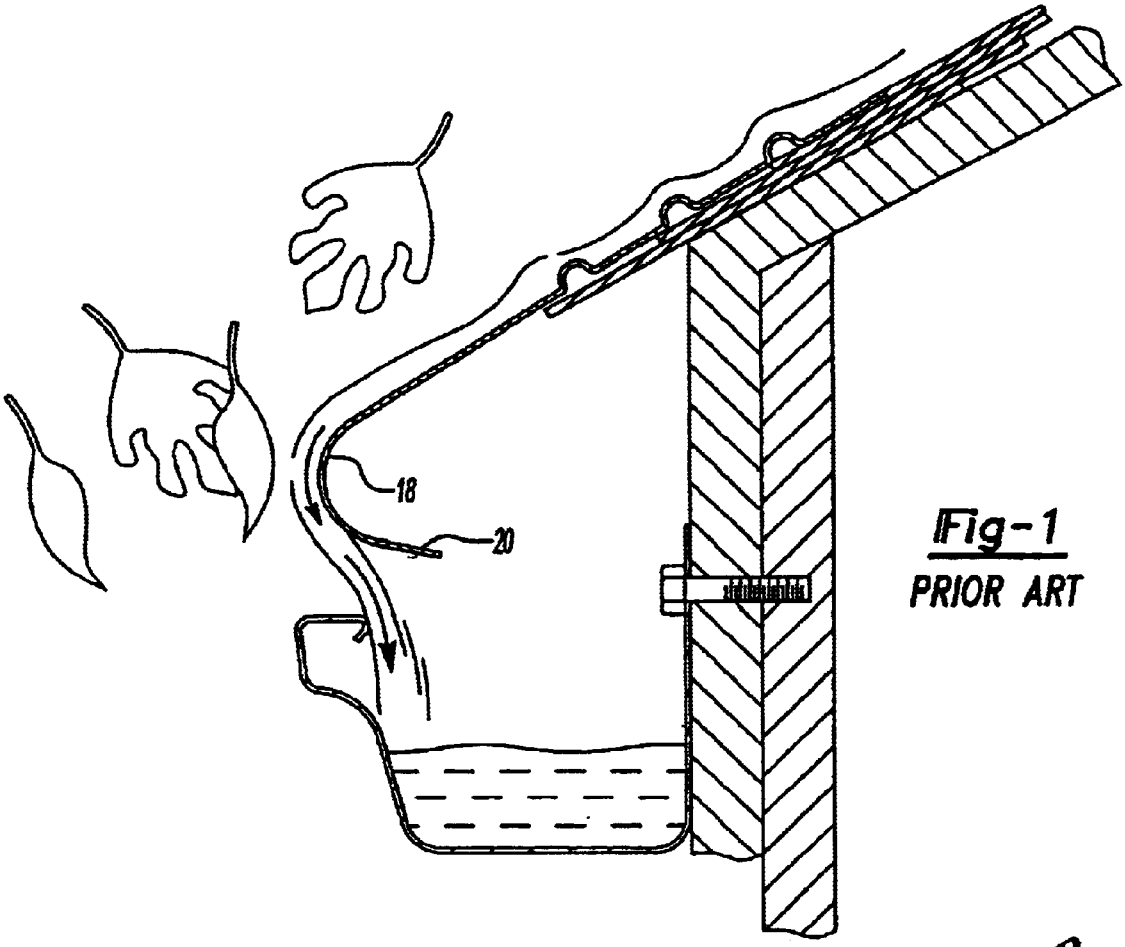
Fig-1 PRIOR ART
FIG. 1 is a cross-sectional view of a prior known gutter cover utilizing physical structure to slow the flow of water across the cover.
Figure 2:
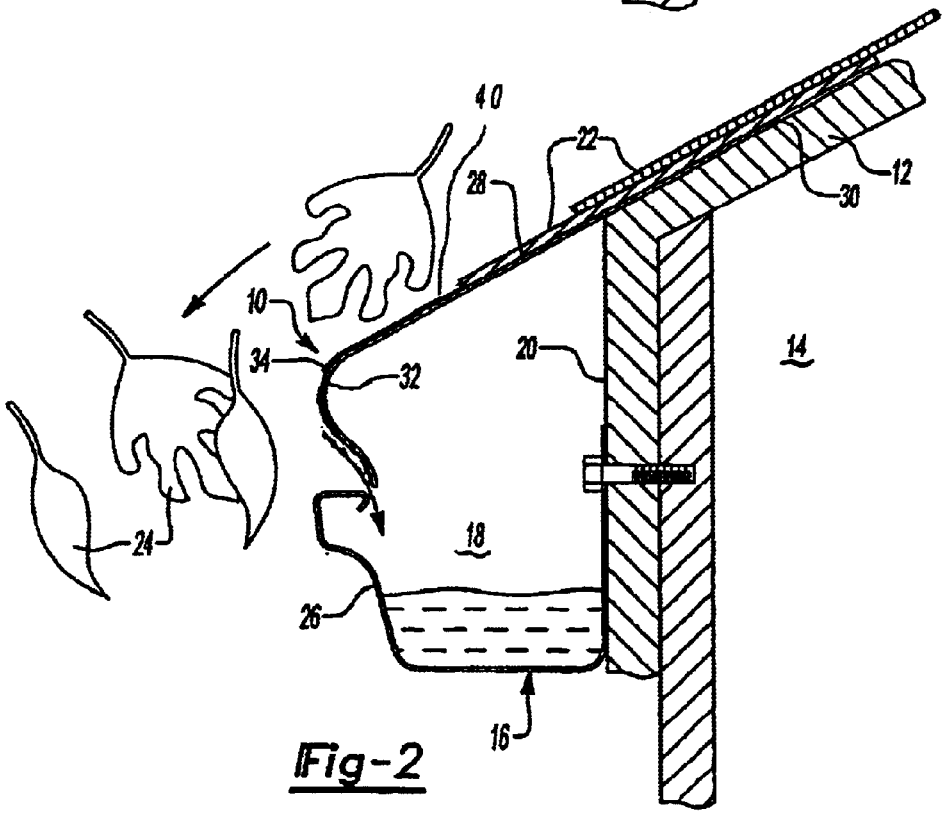
FIG. 2 is a cross-sectional view of the gutter cover embodying the present invention.
Figure 3:
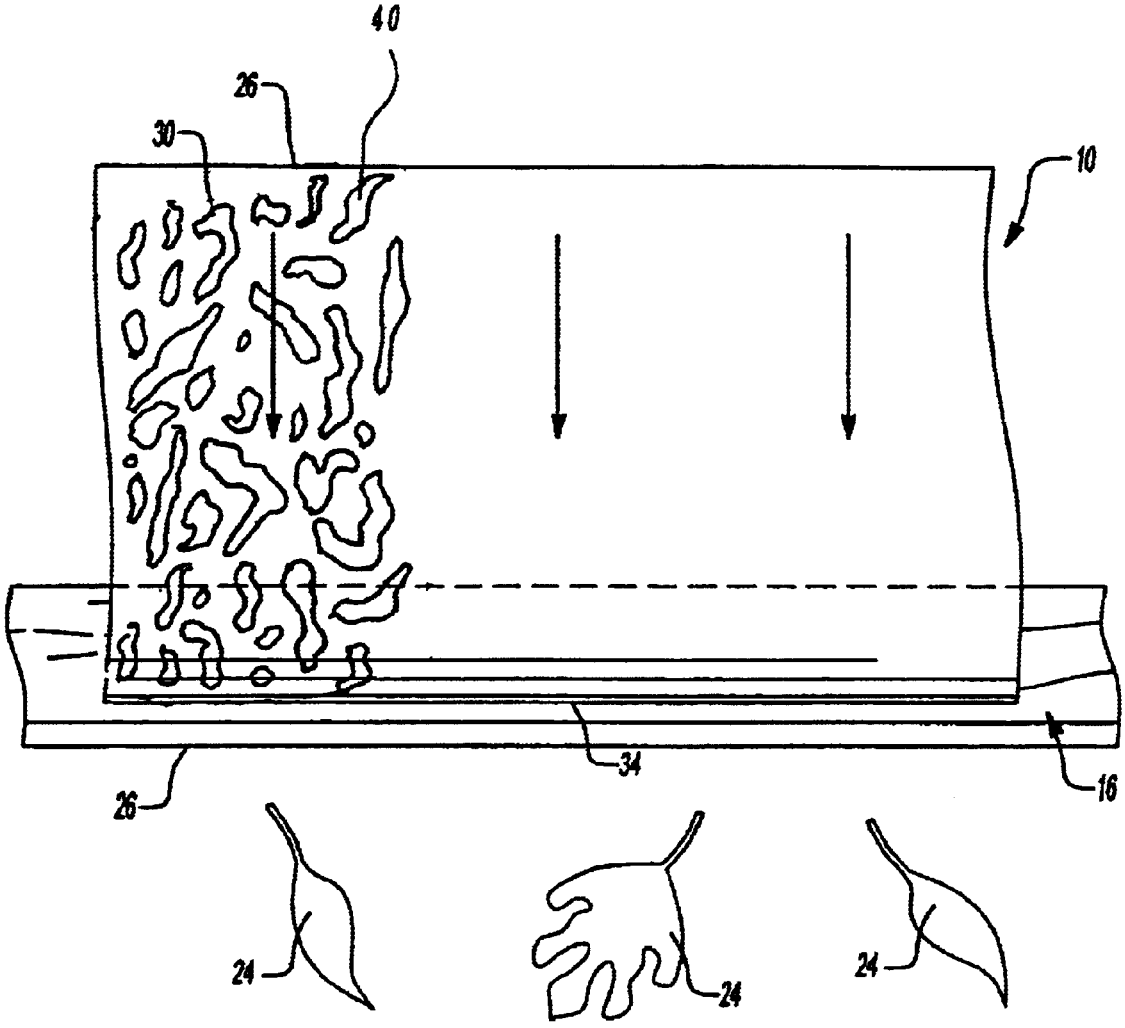
FIG. 3 is a top plan view of the gutter cover in conjunction with a rain gutter

Referring to FIGS. 2 and 3, there is shown a gutter cover 10 embodying the present invention attached to a roof 12 of a building 14 proximate a gutter 16 mounted along the periphery of the roof 12. The gutter 16 is adapted to collect rainwater and similar fluid runoff from the roof 12 and direct it to downspouts (not shown) for delivery to runoff areas. As is well known, the gutter 16 forms a trough 18 and is mounted to a fascia 20 of the building 14 just below the edge of the roof 12. The roof 12 will be covered with a plurality of shingles 22 to protect the building 14 against leaks.

The gutter cover 10 of the present invention is a device designed to slow the flow of water thereby improving flow to ensure the runoff is directed into the gutter 16 while expelling debris 24 such as leaves and twigs outwardly over the front edge 26 of the gutter 16. The cover 10 includes a substantially planar upper portion 28 having an upper longitudinal edge 30 and an arcuate nose 32 forming a lower or outer longitudinal edge 34. In a preferred installation, the upper edge 28 is inserted beneath the shingle 22 such that run-off from the shingles 22 will flow onto the cover 10. Alternatively, the upper edge 28 may be installed over the shingles 22. Typically, a roofing nail or screw is used to secure the planar portion 26 to the roof 12. The cover 10 is installed such that the arcuate nose 32 is positioned over the gutter 16 preferably to an outer portion of the gutter 16 to minimize the gap between the cover 10 and the front wall 26 of the gutter 16 to prevent debris from entering the gutter 16. To prevent dislodgement or displacement of the front edge 34 of the cover 10, a plurality of spaced clips (not shown) may be employed to fasten the front edge 34 of the cover 10 to the gutter 16 while still allowing the flow of water into the gutter 16.

Using a single planar cover on the gutter would cause the water to spill outwardly beyond the gutter 16 particularly as the pitch of the roof 12 and therefore the velocity of the water flow increases. The flow of the water is diverted and spread such that the flow will follow the arcuate nose 32 into the gutter 16. While the prior known gutter covers have employed structural modifications, the present invention contemplates modifying the surface of the cover to improve flow. Embodiments of the present invention include the application of coatings 40 and/or substrates 42 to spread the water flow across the cover thereby improving flow, aid in the release of dirt from the cover, and increase resistance to fading and staining. Moreover, such coatings 40 and substrates 42 could be applied in different combinations over the width of the cover 10 as the water flows across the cover 10.

In the most basic embodiment of the invention, the entire surface of the cover 10 is coated with a composition 40 which will improve the flow of the water as it flows transversely across the cover 10. Such compositions 40 may include polyester, silicone-polyester, or polyvinylidine fluoride. The preferred coating material is a composition of 30% acrylic and 70% polyvinylidine fluoride such as the coating material distributed under the trademark "Fluro Pon" by Valspar Manufacturing.

Alternatively, a substrate 42 texture may be applied to the surface of the cover 10. Such substrates 42 may include a stucco embossment or a diamond, dimple or pimple embossment to provide a texture to the outer surface of the cover 10.

The substrate 42 texture and coating 40 can be applied in combinations not only to improve the flow of the water across the cover 10 but also alter the flow properties along different segments of the panel. By way of example, both a particular substrate 42 texture and a specific coating material 40 may be applied to the entire panel surface. Alternatively, a substrate 42 texture and/or a coating 40 may be applied to the upper planar portion 28 of the cover 10 while a different substrate 42 texture and/or a coating 40 may be applied to the arcuate nose 32 of the cover 10. The possible combinations of coating 40 and substrate 42 are outlined in Table 1 herein.

TABLE I

The Invention:
Gutter protection system that keeps homeowners
from cleaning leaves and debris from inside their gutters.
The Panel Profile, although not new:
controls the way that water is metered around the profile of the panel, and aids in the adhesion of the water to the underside of the panel as the water flows around the panel and into the gutter.
The Coating: PVDF = Polyvinylidine Fluoride

| Coating | | |
|---|---|---|
| Coating Family | Coating Name | Coating Manufacturer |
| Polyester | Polyester | Valspar/Nichols Aluminum |
| Polyester | Polydure 1000 | Akzo Nobel |
| Silicone Polyester | Coil Clad 10S | Valspar |
| Silicone Polyester | Ceram-A-Star 950 | Akzo Nobel |
| PVDF | Fluro Pon | Valspar |
| PVDF | Fluro Pon L/S | Valspar |
| PVDF | Kinar | Valspar |
| PVDF | Trinar | Akzo Nobel |

The various coatings all aid in the release of dirt from the panel, increase the resistance to fading due to exposure, increase the resistance to staining, and aid in the spreading of water across the panel.

TABLE I-continued

| The Substrate Texture: | |
|---|---|
| Textured | Un-Textured |
| Stucco Embossed | Smooth - No texture name |
| Diamond Embossed | — |

The un-textured material assists in the release of dirt.
The two embossed textured materials assist in the release of dirt, add strength to the panel, and help to spread water over the surface of the panel.

Coating/Texture Combinations: PVDF = Polyvinylidine Fluoride

| Coating | | Texture | | |
|---|---|---|---|---|
| Coating Family | Coating Name | Stucco Embossed | Diamond | Smooth - No Texture |
| Polyester | Polyester | X | X | X |
| Polyester | Polydure 1000 | X | X | X |
| Silicone Polyester | Coil Clad 10S | X | X | X |
| Silicone Polyester | Ceram-A-Star 950 | X | X | X |
| PVDF | Fluro Pon | X | X | X |
| PVDF | Fluro Pon L/S | X | X | X |
| PVDF | Kinar | X | X | X |
| PVDF | Trinar | X | X | X |

The surface treatment contemplated by the present invention is intended to improve the release of dirt, increase resistance to fading, resist staining and improve the flow of the water to ensure that water is directed around the arcuate nose 32 of the cover 10 into the gutter 16 while debris 24 is prevented from entering the gutter 16.

The foregoing detailed description has been given for clearness of understanding only and no unnecessary limitations should be understood therefrom as some modifications will be obvious to those skilled in the art without departing from the scope and spirit of the appended claims:

What is claimed is:

1. In a roof structure having a water control system including a gutter positioned at an edge of the roof structure, the gutter forming a trough for collection of water flowing from the roof structure, a gutter cover adapted to direct water flow into the gutter while preventing debris from entering the gutter, said gutter cover comprising:

a continuous elongated body having a substantially planar upper portion and an arcuate nose forming a lower portion of said elongated body, said arcuate nose positioned above the trough of the gutter and said planar upper portion affixed to the roof structure;

a substrate texture applied to said cover body; and a coating comprising polyvinylidine fluoride and acrylic applied to a surface of said cover body, the combination of substrate texture and coating improving the flow of water flowing across the cover such that water flow follows the contour of said arcuate nose into the gutter while debris associated with the water is substantially jettisoned off said cover without entering into the gutter.

2. The gutter cover as defined in claim 1 wherein said coating is applied to said cover body in such a way to form said textured surface on said cover body to improve the flow of water across the cover.

3. The gutter cover as defined in claim 1 wherein said coating prevents staining of said cover.

4. The gutter cover as defined in claim 1 wherein said coating prevents build-up of debris on said cover.

5. The gutter cover as defined iii claim 1 wherein said substrate texture is an embossed pattern formed in said cover body.

6. The gutter cover as defined in claim 5 wherein said embossed pattern is one of a diamond pattern, dimples, pimples and parallel ribs.

7. In a roof structure having a water control system including a gutter positioned at an edge of the roof structure, the gutter forming a trough for collection of water flowing from the roof structure, a gutter cover adapted to direct water flow into the gutter while preventing debris from entering the gutter, said gutter cover comprising:

a continuous elongated body having a substantially planar upper portion and an arcuate S-shaped nose forming a lower portion of said elongated body, said arcuate S-shaped nose positioned above the trough of the gutter and said planar upper portion affixed to the roof structure;

a substrate texture applied to said cover body; and a coating comprising polyvinylidine fluoride and acrylic applied to a surface of said cover body, the combination of substrate texture and coating improving the flow of water flowing across the cover such that water flow follows the contour of said arcuate nose into the gutter while debris associated with the water is substantially jettisoned off said cover without entering into the gutter.

8. The gutter cover of claim 7 wherein said substrate texture comprises an embossed stucco pattern.

9. In a roof structure having a water control system including a gutter positioned at an edge of the roof structure, the gutter forming a trough for collection of water flowing from the roof structure, a gutter cover adapted to direct water flow into the gutter while preventing debris from entering the gutter, said gutter cover comprising:

a continuous elongated body having a substantially planar upper portion with an upper edge inserted beneath shingles of said roof structure and an arcuate nose forming a lower portion of said elongated body, said arcuate nose positioned above the trough of the gutter and said planar upper portion affixed to the roof structure;

a substrate texture applied to said cover body; and a coating comprising polyvinylidine fluoride and acrylic applied to a surface of said cover body, the combination of substrate texture and coating improving the flow of water flowing across the cover such that water flow follows the contour of said arcuate nose into the gutter while debris associated wit the water is substantially jettisoned off said cover without entering into the gutter.

* * * * *